US005593147A

United States Patent [19]

Read

[11] Patent Number: 5,593,147

[45] Date of Patent: Jan. 14, 1997

[54] FREE-STANDING TWO-WAY BAR CLAMP

[76] Inventor: Kenric W. Read, 82 Lawton Foster Rd. South, Hopkinton, R.I. 02833

[21] Appl. No.: 533,387

[22] Filed: Sep. 25, 1995

[51] Int. Cl.[6] ..... B25B 5/02

[52] U.S. Cl. ..... 269/170; 269/6; 269/283; 269/901

[58] Field of Search ..... 269/3, 6, 45, 90, 269/95, 152, 153, 165, 166, 167, 168, 169, 170, 171, 88, 201, 203, 216, 228, 261, 283, 43, 279, 901; 81/126, 152, 487

[56] References Cited

U.S. PATENT DOCUMENTS

| | | | |
|---|---|---|---|
| D. 334,524 | 4/1993 | Pinkney . | |
| 1,479,209 | 1/1924 | Topp | 269/901 |
| 1,574,585 | 2/1926 | Linnig | 269/279 |
| 4,306,710 | 12/1981 | Vosper . | |
| 4,478,397 | 10/1984 | Krueger | 269/901 |
| 4,779,857 | 10/1988 | Maund | 269/71 |
| 4,989,847 | 2/1991 | Chapman | 269/170 |
| 5,022,137 | 6/1991 | Sorensen et al. . | |
| 5,094,131 | 3/1992 | Sorensen et al. . | |
| 5,222,420 | 6/1993 | Sorensen et al. . | |
| 5,454,551 | 10/1995 | Hobday | 269/6 |

*Primary Examiner*—Bruce M. Kisliuk
*Assistant Examiner*—Thomas W. Lynch

[57] ABSTRACT

A hand tool containing a movable jaw mount, a slide bar wherein the movable jaw mount is mounted to the slide bar. A support assembly is provided for supporting the slide bar. A stationary jaw mount is spaced away from the support assembly. Interchangeable quick change jaws are mounted to both the movable jaw mount and the stationary jaw mount. Quick change jaws face each other for clamping operations and face away from each other for spreading operations. A two-way drive arrangement is designed having at least an engagement lever. A handle engages the engagement lever when the two-way drive arrangement is engaged, and disengages the engagement lever when the two-way drive arrangement is released. A support structure mount is mounted to the slide bar. A quick release support structure is mounted to the support structure mount providing free-standing capability.

7 Claims, 5 Drawing Sheets

FREE-STANDING TWO-WAY BAR CLAMP

BACKGROUND—FIELD OF INVENTION

This invention relates to bar clamps, specifically to such clamps which are operated using one hand.

BACKGROUND—DESCRIPTION OF PRIOR ART

This invention relates generally to a bar clamp of the type used to temporarily clamp together two articles, for example, for gluing, or to hold a workpiece for soldiering, welding or drilling. More particularly this invention relates to a quick-action bar clamp wherein the movable jaw can be rapidly advanced or advances in small increments of selectable length in two directions.

Alternatively, the invention can be used as a spreader to spread apart elements of the same article or two separate articles.

The concept of the bar clamp is well known. In recent years bar clamps have been improved to include one-handed quick-action operation. Examples are U.S. Pat. Nos. 5,022,137 and 5,094,131, both to Sorensen & Gatzemeyer (1991) and (1992), respectively. A disadvantage in the prior art is that the movable jaw engages with force and is incrementally advanced in only one direction. Additionally, if the tool is to be used as a spreader, the fixed jaw must be disassembled from the bar and moved to the opposite end, jaws facing away from each other. This is cumbersome and requires tools and too much time. Additional disadvantage in the prior art is that the clamp is not free-standing, thereby preventing an operator from clamping and holding a workpiece suspended from a workbench or work surface.

What is needed is a bar clamp having an engagable two-way body, quick-changing jaws and free-standing capability. This clamp should be rapidly movable over both long and short distances to clamp against a workpiece. It should also be operable with one hand with complete control by the operator at all times.

OBJECTS AND ADVANTAGES

Generally speaking, in accordance with the invention, a versatile free-standing two-way bar clamp especially suitable for rapid and precise closure and opening against a workpiece is provided. The clamp includes interchangeable jaws for both fixed and movable bodies which either hold or spread a workpiece. The movable jaws connect at both ends to a slide bar which is movable to advance the movable jaws toward and away from the fixed jaws. Two-way drive means, by operation of a handle, releasably engages the slide bar and advances the movable jaws toward the fixed jaws. Conversely, the two-way drive means, by operation of a handle also engages the slide bar and advances the movable jaws away from the fixed jaws. Return motion of the movable jaw is accomplished manually when the two-way drive means is disengaged or the handle is operated in the reverse direction. In both forward and reverse directions first and second brake levers which are biased by springs to bind against the slide bar prevent any motion of the movable jaws. To move the movable jaws away from the fixed jaws, the corresponding brake lever that is biased to prevent reverse motion is disengaged from the slide bar. Thus for return motion of the moving jaw, it is necessary that both the two-way drive means and the respective brake lever be disengaged or that the handle simply be operated in the desired direction of travel. The handle advances the movable jaws by driving third or fourth levers which binds against a surface of the slide bar. This binding action moves the jaws as the third or fourth lever moves toward one of the fixed jaws. The third and fourth levers are returned by spring force to its original position after each stroke of the trigger handle. The third and fourth levers slide over the bar surface during its return motion.

Both fixed and movable jaws are removable and can be replaced by jaws suiting various purposes. Both the fixed and the movable jaws contain receiver mounting bodies that are positioned upon receiver mounts and are held together by quick release pins. Removal of the pins allows rapid interchangability of jaws and easy repositioning for either clamping or spreading operations.

Integral to the bottom of both movable jaw mounts are surfaces that allow attachment of a cross member. This cross member has a receiver mounting body and support members attached. By placing the cross member receiver mount body onto the integral jaw mounts, inserting quick-release pins and then extending the support structures, the whole bar clamp assembly stands by itself.

Accordingly, the object and advantages of this invention are to provide an improved two-way quick-action bar clamp wherein:

(a) the movable jaw can be engagably advanced in two directions, (b) the clamp in total is capable of standing on a horizontal planar surface independently, (c) the fixed and movable jaws are interchangeable and/or replaceable quickly and without the use of tools, (d) the moving jaw may be moved over short and long distances rapidly, (e) the moving jaw may be incrementally and precisely advanced from any position, (f) the moving jaw may be advanced in increments of selectable length for each action of a driving handle, (g) the movable jaw does not move when the clamp is in a vertical position, and (h) clamp operation is accomplished with one hand.

Still other objects and advantages of the invention will in part be obvious and will become apparent from the specification.

The invention accordingly, comprises the features of construction, combination of elements, and arrangement of parts which will be exemplified in the construction hereinafter set forth, and the scope of the invention will be indicated in the claims.

DRAWING FIGURES

In the drawings, closely related figures have the same number but different alphabetic suffixes.

For a fuller understanding of the invention, reference is had to the following description taken in connection with the accompanying drawings, in which.

Figure 1:
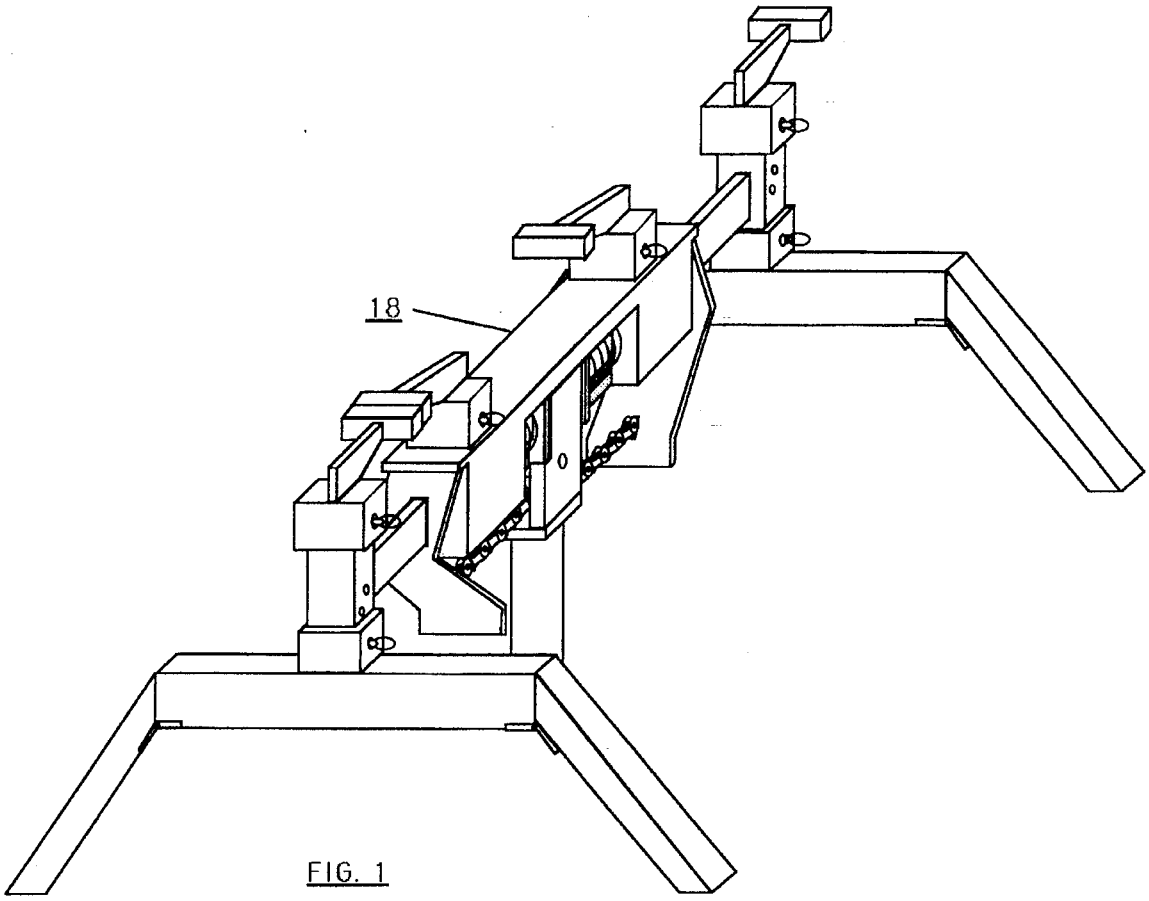
FIG. 1 is an isometric view of the quick-action bar clamp in accordance with the invention.

| Reference Numerals in Drawings | |
|---|---|
| 22 rear fixed jaw | 23 front fixed jaw |
| 24 slide bar | 25 front fixed jaw mount |
| 26 front opening | 27 rear fixed jaw mount |
| 28 intermediate-front opening | 29 front movable jaw mount |
| 30 intermediate-rear opening | 31 rear movable jaw mount |
| 32 rear opening | 34 support means |
| 36 front movable jaw | 38 rear movable jaw |
| 40 body | 42 front body portion |
| 44 rear body portion | 46 upper body support |
| 48 lower body support | 50 handle |
| 51 pivot pin hole | 52 pivot pin |
| 54 upper body support ext. | 55 grip |
| 56 lower body support ext. | 57 handle mount hole |
| 58 stop surface, plate | 59 center section of chain |
| 60 stop surface, plate | 62 engagement plate |
| 64 engagement plate | 66 spring |
| 68 spring | 70 engagement lever hole |
| 72 engagement lever hole | 74 spring stop surface |
| 76 spring stop surface | 78 direction of motion |
| 80 direction of motion | 82 brake lever |
| 84 brake lever | 86 brake lever hole |
| 88 brake lever hole | 90 brake lever, toe end |
| 92 brake lever, top end | 94 brake-body recess |
| 96 brake-body recess | 98 compression spring |
| 100 compression spring | 102 brake spring recess |
| 104 brake spring recess | 106 body surface |
| 108 body surface | 110 brake lever grip |
| 112 brake lever grip | 114 attachment surfaces |
| 116 attachment surfaces | 118 brake release chain |
| 120 brake attachment point | 122 brake release pin |
| 124 brake depression direction | 126 brake depression direction |
| 128 brake lever surface | 130 brake lever surface |
| 131 upper end of handle | 132 side surfaces of handle |
| 134 side surfaces of handle | 136 engagement plate pivot |
| 138 engagement plate pivot | 140 movable jaw mount pin |
| 141 movable jaw mount pin | 142 movable jaw mount pin |
| 143 movable jaw mount pin | 144 movable jaw mount opening |
| 146 movable jaw mount opening | 148 ball-lock pin |
| 149 ball-lock pin | 150 jaw receiver |
| 151 ball-lock pin | 153 ball-lock pin |
| 154 jaw receiver mount hole | 156 jaw mount hole |
| 158 jaw - on direction | 160 jaw - off direction |
| 162 cross-member receiver | 164 cross-member |
| 166 ball-lock pin | 168 cross-member receiver hole |
| 170 jaw mount cross-member hole | 172 support member |
| 174 support member | 176 extension direction |
| 178 extension direction | 180 hinge |
| 182 hinge | 184 inner surface |
| 186 inner surface | 188 cross member bottom surface |
| 192 cross-member receiver | 194 cross-member |
| 196 ball-lock pin | 198 cross-member receiver hole |
| 200 jaw mount cross-member hole | 202 support member |
| 204 support member | 206 extension direction |
| 208 extension direction | 210 hinge |

-continued

| Reference Numerals in Drawings | |
|---|---|
| 212 hinge | 214 inner surface |
| 216 inner surface | 218 cross member bottom surface |

DESCRIPTION—FIGS. 1 TO 12, 14, 15

Although a specific embodiment of the invention will now be described with reference to the drawings, it should be understood that the embodiment shown is by way of example only and merely illustrative of but one of the many possible specific embodiments which can represent applications of the principles of the invention. Various changes and modifications, obvious to one skilled in the art to which the invention pertains are deemed to be within the spirit, scope and contemplation of the invention as further defined in the appended claims.

Referring to FIG. 1, the hand tool of the invention is shown at 18 fully assembled.

Referring now to FIGS. 2, 3 , 4 and 5, the hand tool or improved bar clamp of the invention is shown at 20 and includes movable jaw mounts 29 and 31 mounted to a slide bar 24. The slide bar 24 is movable within openings 26, 28, 30 and 32 of a support assembly or support means 34. Fixed jaw mounts 25 and 27 opposing the movable jaw mounts 29 and 31 extend upwardly from the support means 34.

The support means 34 has a body 40 with front 42 and rear 44 portions.

Figure 3:
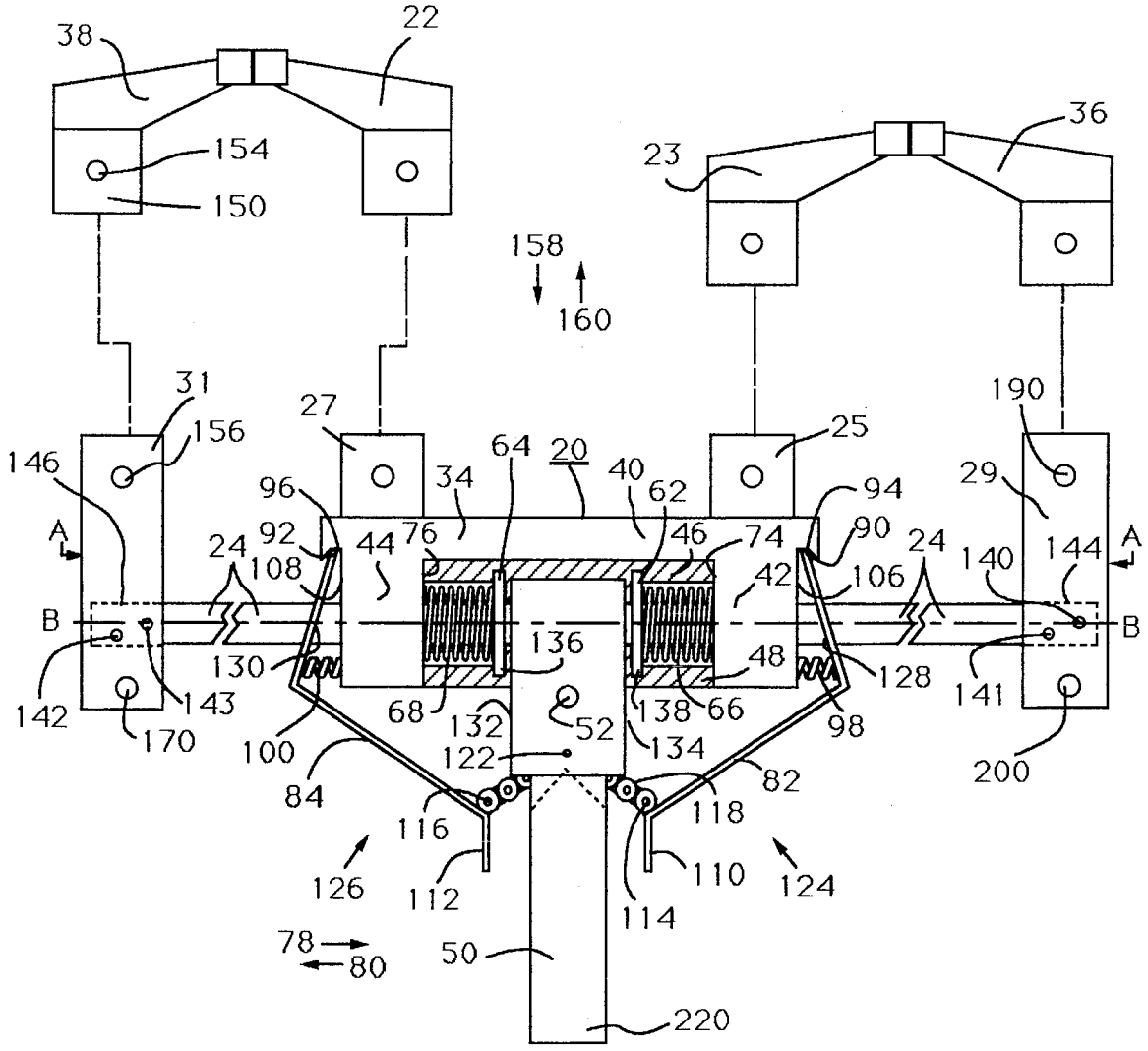
FIG. 3 is a side view of the quick-action bar clamp, having the support assemblies removed.
Figure 4:
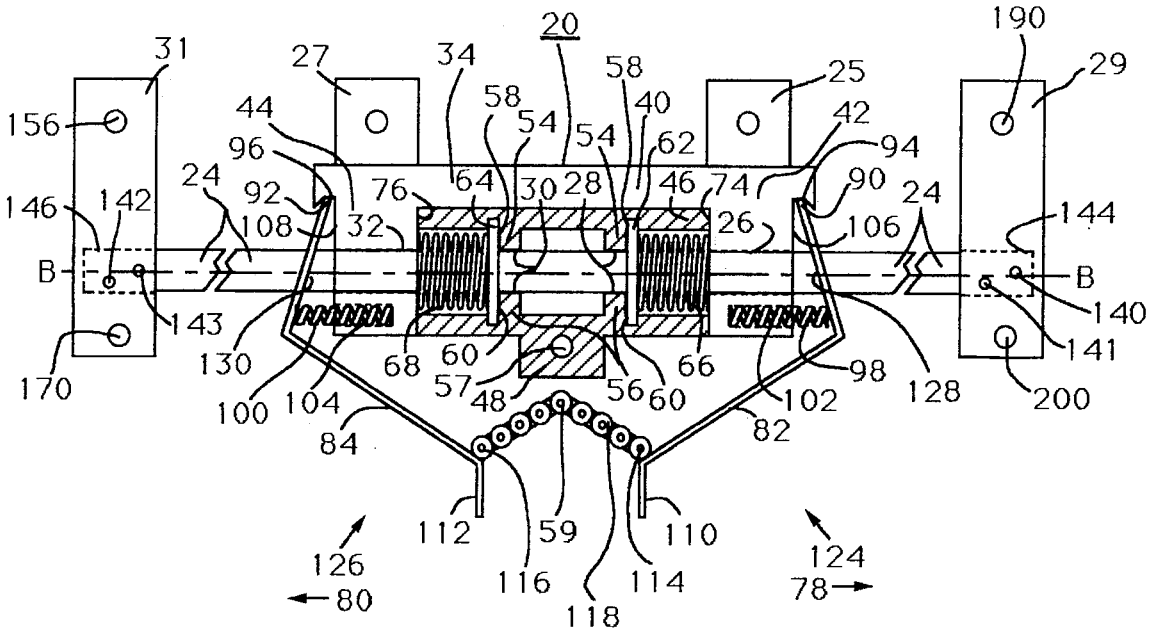
FIG. 4 is a side view of the quick-action bar clamp, having the support assemblies and handle removed.
Figure 5:
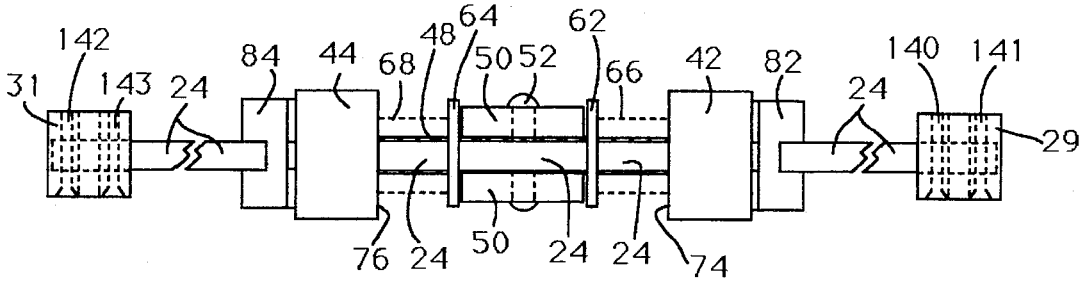
FIG. 5 is a sectional view of the quick-action bar clamp along the axis sectional lines AA of FIG. 3.

On both sides, the front 42 and rear 44 portions are interconnected by body supports 46 and 48 which extend along a longitudinal axis B-B of the support assembly and the slide bar. As shown in FIGS. 3 and 4, the support elements 46 and 48 are substantially parallel to the longitudinal axis of the support means 34. However, other positions of the supports 46 and 48 are possible. The openings 26, 28, 30 and 32 are situated correspondingly within the front, intermediate and rear portions.

FIGS. 3 and 4 illustrate that the longitudinal axis B-B of the slide bar is substantially parallel and/or coincides with the longitudinal axes of the openings 26, 28, 30 and 32. In the support means 34, the slide bar is positioned between the upper support element 46 and the lower support element 48. The motion of the slide bar is supported by surfaces of the four openings, in the front, intermediate and rear portions of the support assembly. Such multiple support of the slide bar greatly enhances stability of the clamping operation. The upper body support 46 and the lower body support 48 have extension surfaces 54 and 56 that provide support at openings 28 and 30. These extensions 54 and 56 also provide stopping surfaces 58 and 60 to retain engagement plates/levers 62 and 64 in a standby position.

A handle 50 is pivotably mounted to the body support 48 by means of a pivot pin or connection 52. Referring now to FIGS. 3, 4, 6A and 6B, the handle 50 has a pivot pin hole 51 that aligns with the handle mount hole 57 located on the lower body support 48. Insertion of pivot pin 52 holds the handle 50 in place and allows pivotal motion about the longitudinal axis of the pivot pin 52. The handle also has a brake release lever mount hole 120 that allows attachment of the brake release chain 118 to the handle 50. Alignment of the hole 120 to a center section 59 of the chain 118 allows insertion of the brake release pin 122. The attachment of brake release chain 118 to the handle allows brake release action when pivotal motion is applied to the handle 50. For illustrative purposes the pivotal connection between the handle 50 and the handle mount hole 57 is shown to be positioned in the center of body support 48. However, any suitable location of the pivotal connection is within the scope of the invention.

The handle 50 extends into a first cavity created between the engagement plates 62 and 64 which rest upon stops 58 and 60. Engagement plates 62 and 64 are held in place against stops 58 and 60 by the compression action of springs 66 and 68.

Referring now to FIGS. 2, 3, 4, 5, 7A and 7B, engagement plates 62 and 64 are located and/or suspended on the slide bar 24 which passes through holes 70 and 72 in the engagement plates 62 And 64. Compression springs 66 and 68 are located between the engagement plates 62 and 64 and surfaces 74 and 76 respectively of the front and rear body portions 42 and 44. The compression action of the springs 66 and 68 urges the engagement plates 62 and 64 against the stops 58 and 60 of the upper and lower body supports 46 and 48 thus providing a standby condition. The handle 50 is suitably in the form of a fork so as to straddle the upper and lower body supports 46 and 48, including the stops 58 and 60, the body support extensions 54 and 56 and the slide bar 24.

In the standby condition, the engagement levers 62 and 64 are positioned substantially perpendicular to the direction of motion, indicated by the arrows 78 and 80, of the slide bar 24 when in operation. Motion of the handle 50 about the pivot pin 52 in the direction of the arrow 78 moves the slide bar 24 against the bias of the spring 68 through the engagement lever 64. Motion of the handle 50 about the pivot pin 52 in the direction of the arrow 80 moves the slide bar 24 against the bias of the spring 66 through the engagement lever 62.

Referring now to FIGS. 3, 4, 8A, 8B, 8C and 8D, the slide bar 24 passes through openings 86 and 88 in the brake levers 82 and 84. One end 90 and 92 of the brake levers 82 and 84 is pivotably positioned in recesses 94 and 96. This allows the brake levers 82 and 84 to pivot within constraints defined by the surfaces of the recesses 94 and 96. It also allows binding of the brake levers 82 and 84 with the slide bar 24 when the edges of the openings 86 and 88 in the levers 82 and 84 engage the end surfaces of the slide bar 24. AS best illustrated in FIGS. 3 and 4, the recesses 94 and 96 are situated in the vicinity of the end of front body portion 42 and rear body portion 44.

At least one compression spring 98 and 100 per side is seated in recesses 102 and 104 in the body supports 42 and 44 and biases the free end of the brake levers 82 and 84 away from the surfaces 106 and 108 of supports 42 and 44. The biased position of brake release levers 82 and 84 is accomplished by the compressive action of springs 98 and 100 against the back sides 128 and 130 of levers 82 and 84. The biased position of the brake levers 82 and 84 is limited by the binding/or cocking interference between the openings 86 and 88 of the levers 82 and 84 and the end surfaces of the slide bar 24.

The grip portions 110 and 112 of brake levers 82 and 84 contain attachment surfaces whereby a brake release chain 118 or other suitable lever may be attached. The chain spans from attachment surfaces 114 and 116 of brake levers 82 and 84 to the handle brake release lever mount hole 120 which is situated below the pivot pin 52 on the same vertical axis. The chain 118 is held in place by a brake release pin 122, or other suitable attachment method, which is inserted traversly through the handle 50 at the attachment hole 120 and through the chain 118 simultaneously.

Quick change jaws 36 and 38 are attached to movable jaw mounts 29 and 31 respectively, by means of ball-lock pins 148 and 149. Quick change jaws 23 and 22 are attached to fixed jaw mounts 25 and 27, respectively by means of ball-lock pins 151 and 153. Other quick-change devices can be used in place of ball-lock pins. Jaw mounts 25, 27, 29 and 31 are uniform in size and shape enabling jaws 22, 23, 36 and 38, which are also uniformly made, to be easily changed between mounts, reversed in direction, or removed as the operator desires. FIGS. 9, 10, 11 and 12 show a general purpose quick-change jaw 222, a pipe clamp jaw 224, a wood-working jaw 226 and a welding jaw 228, respectively, which can be quickly exchanged to suit the operator's need.

Representative of operation of all four mounts, one mount and jaw combination will be described. Referring to FIGS. 2, 3, 4, 5, shape and size of the receiver portion 150 of the quick change jaw 38 is made similarly to and slightly larger than either the movable jaw mount 31. The jaw 38 is slid onto mount 31 in the direction of arrow 158 aligning jaw hole 154 with the mount hole 156. The ball lock pin 149 is inserted through jaw hole 154 and jaw mount hole 156 to secure jaw 38 to the bar 24. To quickly remove the jaw 38 from the bar 24, simply extract the ball lock pin 149 out of holes 154 and 156 and pull the jaw 38 in the direction of arrow 160. The ball lock pins can be secured to the jaw mount 25, 27, 29, and 31 by any conventional means such as a lanyard or string. Quick change jaws 36 and 38 hereafter will be referred to as movable jaws 36 and 38 because of the mounting location. Quick change jaws 23 and 22 hereafter will be referred to as fixed jaws 23 and 22 because of the mounting location.

It should be noted that in the standby position illustrated in FIGS. 3 and 4, the engagement levers 62 and 64 are substantially perpendicular to the longitudinal axis B—B of the slide bar 24, whereas the portions of brake levers 82 and 84 which engages the slide bar 24 are transversely oriented to the longitudinal axis of the bar 24 at a slight angle. In this condition, if a force is applied to the movable jaws 36 and 38 the direction indicated by either arrow 78 or 80, the slide bar 24 binds and is not free to move through all the openings 26, 28, 30 and 32. The end edges of the openings 86 and 88 in the brake levers 82 and 84 bind against the surfaces of the slide bar 24 and it is not possible to move the movable jaws in either direction.

If a force is applied in the direction of arrow 78 to the movable jaw 38, brake lever 82 must be released to enable movement. Because the brake lever 84 is free to pivot against the bias of the spring 100 when force is applied on the fixed jaw 38 in the direction of the arrow 78, the brake lever 84 presents no obstacle to this motion of the slide bar. When the brake lever 82 is released the movable jaw 38 may be advanced continuously toward the fixed jaws 22 and 23.

If a force is applied in the direction of arrow 80 to the movable jaw 36, brake lever 84 must be released to enable movement. Because the brake lever 82 is free to pivot against the bias of the spring 98 when force is applied on the movable jaw 36 in the direction of the arrow 80, the brake lever 82 presents no obstacle to this motion of the slide bar. When the brake lever 84 is released the movable jaw 36 may be advanced continuously toward the fixed jaws 22 and 23.

However, simultaneous compression of the springs 98 and 100 by pressing on the brake levers 82 and 84 with a hand in the direction of the arrows 124 and 126, allows withdrawal of the slide bar 24 and its movable jaws 36 and 38 to be extended in either direction 78 or 80. Compression of the springs 98 and 100 brings the surfaces 128 and 130 of the brake levers 82 and 84 into perpendicularity with the direction of intended motion of the slide bar 24, and thus the slide bar 24 is then free to slide in either direction through the openings 86 and 88 in the brake levers 82 and 84 and through support openings 26, 28, 30 and 32.

The handle 50 is moved in the direction indicated by the arrow 78 to incrementally advance the slide bar 24 with the movable jaw 36 toward and simultaneously advance the movable jaw 38 away from the fixed jaws 23 and 22. When the handle 50 is moved in the direction of arrow 78, pivoting occurs about the pivot pin 52 and the upper end 131 of the handle 50 also pivots and moves substantially in the direction of the arrow 80. This causes handle surfaces 132 to contact plate 64 surfaces and subsequent cocking of the plate 64. Consequently, moving the handle 50 in the direction of arrow 78 causes brake release chain 118 to move in direction of arrow 126. Brake release chain 118 being attached to the brake lever 84 at attachment point 116 causes release of binding forces of brake lever 84 allowing movement of the movable jaw 36 and the slide bar toward the fixed jaws 22 and 23. This causes the engagement plate 64 to pivot about its first end 136, so that the engagement lever 64 is no longer perpendicular to the direction 80 of the intended motion of the slide bar 24. Pivoting the engagement lever 64 compresses the spring 68 and also causes the end edges of the hole 72 through the engagement lever 64 to bind against the end surfaces of the slide rod 24. Binding occurs because the engagement lever 64 is no longer perpendicular to the direction 80 of the intended motion of the slide bar 24. Further motion of the handle 50 causes the engagement lever 64 to translate in the direction of the arrow 80. This motion further compresses the spring 68 and in the process, by means of the binding and/or cocking interference between the lever 64 and bar 24, advances the bar 24, and its connected movable jaw 36 towards the fixed jaws 23 and 22. The maximum distance of advance of the movable jaw 36 with one stroke of the handle 50 is limited where the spring 68 is fully compressed if the handle 50 strikes the inner surface 76 of the body rear body portion 44.

However, the stroke of the handle 50 can be through any lesser arc, thereby diminishing the distance the movable jaw 36 travels in a single stroke in proportion to the angle of the handle stroke. Additional strokes may be applied to the handle 50 of any magnitude until the jaws 36, 23 come together, or a workpiece (not shown) is firmly gripped between them.

After the handle 50 is fully pivoted in the direction of the arrow 78 about the pivot pin 52, release of the handle 50 causes the return of the handle 50, engagement plate 64 and spring 68 to the position shown in FIG. 3 as a result of the compressive forces in the spring 68 urging the components toward the stops 58 and 60 and also the compressive forces of spring 100 urging brake lever 84 back to the biased standby position.

Conversely, the handle 50 is moved in the direction indicated by the arrow 80 to incrementally advance the slide bar 24 with the movable jaw 38 toward and simultaneously advance the movable jaw 36 away from the fixed jaws 22 and 23. When the handle 50 is moved in the direction of arrow 80, pivoting occurs about the pivot pin 52 and the upper end 131 of the handle 50 also pivots and moves substantially in the direction of the arrow 78. This causes handle surfaces 134 to contact plate 62 surfaces and subsequent cocking of the plate 62. Consequently, moving the handle 50 in the direction of arrow 80 causes brake release chain 118 to move in direction of arrow 124. Brake release chain 118 being attached to the brake lever 82 at attachment point 114 causes release of binding forces of brake lever 82 allowing movement of the movable jaw 38 and the slide bar 24 toward the fixed jaws 22 and 23. This causes the engagement lever 62 to pivot about its first end 138, so that the engagement lever 62 is no longer perpendicular to the direction 78 of the intended motion of the slide bar 24. Pivoting the engagement lever 62 compresses the spring 66 and also causes the end edges of the hole 70 through the engagement lever 62 to bind against the end surfaces of the slide bar 24. Binding occurs because the engagement lever 62 is no longer perpendicular to the direction 78 of the intended motion of the slide bar 24. Further motion of the handle 50 causes the engagement lever 62 to translate in the direction of the arrow 78. This motion further compresses the spring 66 and in the process, by means of the binding and/or cocking interference between the lever 62 and bar 24, advances the bar 24, and its connected movable jaw 38 towards the fixed jaws 22 and 23. The maximum distance of advance of the movable jaw 38 with one stroke of the handle 50 is limited where the spring 66 is fully compressed if the handle 50 strikes the inner surface 74 of the front body portion 42.

However, the stroke of the handle 50 can be through any lesser arc, thereby diminishing the distance the movable jaw 38 travels in a single stroke in proportion to the angle of the handle stroke. Additional strokes may be applied to the handle 50 of any magnitude until the jaws 38, 22 come together, or a workpiece (not shown) is firmly gripped between them.

After the handle 50 is fully pivoted in the direction of the arrow 80 about the pivot pin 52, release of the handle 50 causes the return of the handle 50, engagement lever 62 and spring 66 to the position shown in FIG. 3 as a result of the compressive forces in the spring 66 urging the components toward the stops 58 and 60 and the compressive forces of spring 98 urging brake lever 82 back to the biased standby position.

The bar 24 is situated in the movable jaw mount openings 144 and 146 and traverse pins or a stops 140, 141, 142 and 143 pass through the movable jaw mounts 29 and 31 and the end of the slide bar 24. This arrangement prevents withdrawal of the slide bar 24 from openings 26, 28, 30 and 32 when the braking lever 82 is pressed in the direction of the arrow 124 and the movable jaw 36 is manually drawn away from the fixed jaw 23. This also prevents withdrawal of the slide bar 24 from openings 26, 28, 30 and 32 when the braking lever 84 is pressed in the direction of the arrow 126 and the movable jaw 38 is manually drawn away from the fixed jaw 22. It should be noted that operation of the handle 50 is effective in accomplishing any motion of the slide bar 50 in either direction of arrows 78 or 80.

In the illustrated embodiment (FIGS. 1 12) in accordance with the invention, the slide bar 24 has a rectangular cross-section. In alternative embodiments in accordance with the invention, the slide bar 24 may be any shape, for example, square, round or triangular. The openings 70, 72 in the levers 62, 64, respectively, openings 144, 146 of the movable jaw mounts 36, 38, respectively, as well as the support openings 26, 28, 30 and 32 would be appropriately shaped for their respective proper binding interference and alignment with the slide bar 24.

Figure 2:
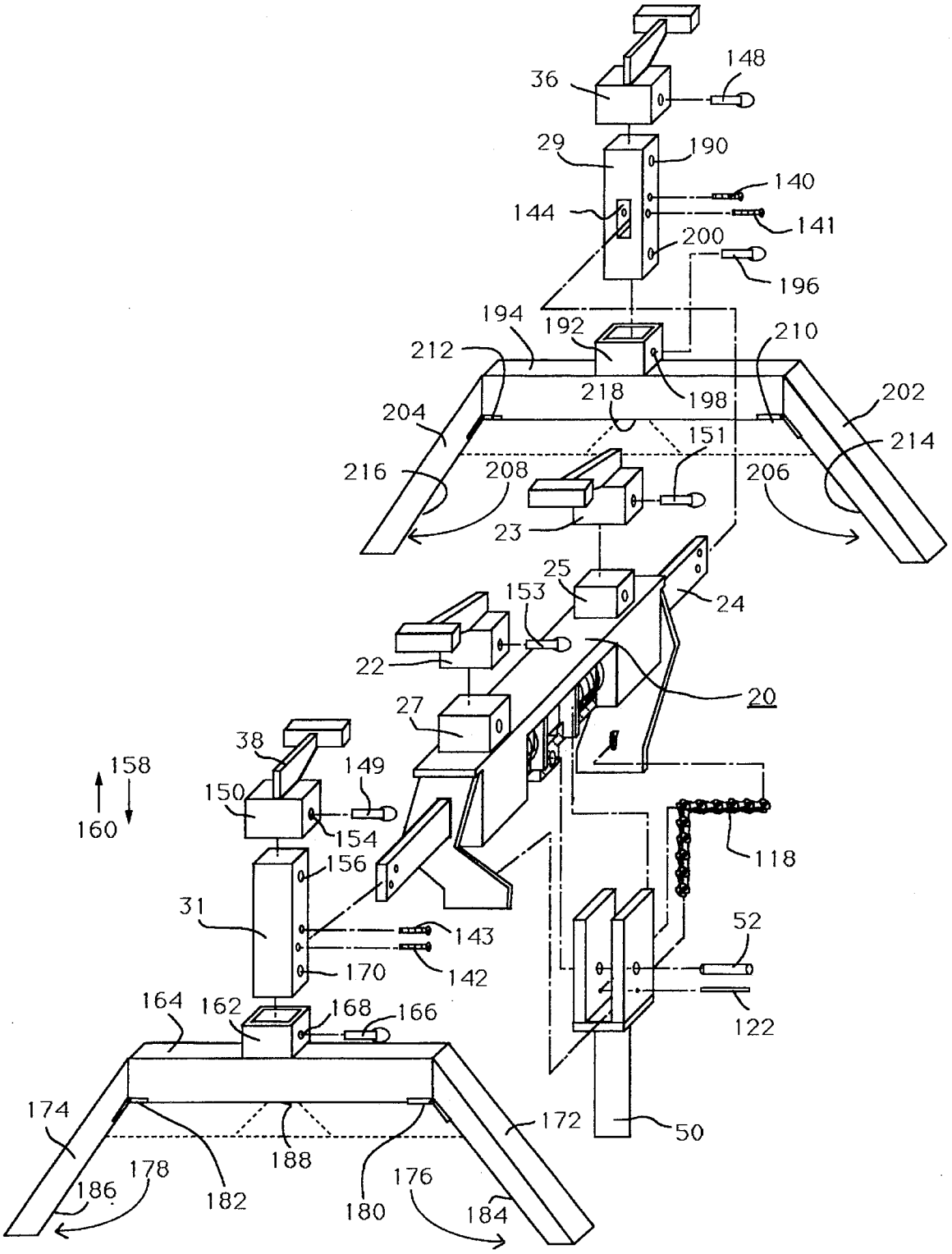
FIG. 2 is an isometric exploded view of the quick-action bar clamp.

The free standing capability of the clamp of the invention is shown in FIGS. 1 and 2. Two cross members 164 and 194 are shown supporting the bar 24 and attached clamp 20. The cross member 164 has an attached receiver 162 that is similarly shaped to a representative jaw receiver 150. The receiver contains hole 168 whereby ball lock pin 166 can be inserted. Holes 168 and mount holes 170 are situated such that they are aligned for receipt of ball lock pin 166, thereby attaching cross member 164 and attached support members 172 and 174 to the bar 24.

The cross member 164 has support members 172 and 174 that extend down and away from the center of the cross member in the general directions of arrows 176 and 178. Members 172 and 174 are equal length so that they set level on a tabletop or other horizontal planar surface (not shown). Support members 172 and 174 are attached to the cross member 164 by means of hinges 180 and 182 or other suitable means, so that legs can be folded up to where inner surfaces 184 and 186 are adjacent to cross member surface 188. Ball lock pin 166 can be secured to the cross-member 164 or other suitable location by any suitable means such as lanyard or string.

The cross member 194 has an attached receiver 192 that is similarly shaped to a representative jaw receiver 150. The cross member receiver contains hole 198 whereby ball lock pin 196 can be inserted. Holes 198 and mount hole 200 are situated such that they are aligned for receipt of ball lock pin 196, thereby attaching cross member 194 and attached support members 202 and 204 to the bar 24.

The cross member 194 has support members 202 and 204 that extend down and away from the center of the cross member 194 in the general directions of arrows 206 and 208. Members 202 and 204 are equal length so that they set level on a tabletop or other horizontal planar surface (not shown). Support members 202 and 204 are attached to the cross member 194 by means of hinges 210 and 212 or other suitable means, so that legs can be folded up to where inner surfaces 214 and 216 are adjacent to cross-member surface 218. Ball lock pin 196 can be secured to the cross-member 194 or other suitable location by any suitable means such as lanyard or string.

The length of the support members 172, 174, 202 and 204 can be made equally various lengths, such as short for tabletop or benchtop operations and longer lengths for standing on the ground at a comfortable height for operators use.

Hence, to convert the bar clamp of the invention as shown in FIGS. 3 and 4 to a stand-alone configuration, the following steps will be performed:

(a) place cross member 164 onto bottom of jaw mount 31, aligning cross-member receiver 162 inner surfaces to fit around jaw mount 31 outer surfaces and aligning holes 168 and 170, (b) place pin 166 through holes 168 and 170, (c) extend supports 172 and 174 fully in the directions of arrows 176 and 178, respectively, (d) place cross member 194 onto bottom of jaw mount 29, aligning cross-member receiver 192 inner surfaces to fit around jaw mount 29 outer surfaces and aligning holes 198 and 200, (e) place pin 196 through holes 198 and 200, (f) extend supports 202 and 204 fully in the directions of arrows 206 and 208, respectively.

In summary, if it is desired that a workpiece is to be held between the jaws 36, 23, or 38, 22 the movable jaws 36 or 38 can be advanced toward the fixed jaws 22 and 23, reducing a gap there-between either in one continuous motion. This is done by merely simultaneously pressing brake levers 82 and 84, and pushing in the direction of the either arrow 78 or 80 on the fixed jaws 22 and 23 or, by operating the handle 50 in either forward or reverse directions in a series of strokes of length to be determined by the user. Large strokes may be used at first and small strokes later as the desired pressure is applied to the workpiece. During this advancing operation, the brake levers 82 and 84 prevent any backward motion (opposite to the desired operator's movement) of the slide bar 24 after each advance has been completed. While the brake levers 82 or 84 holds the bar 24, the handle 50 is released. The spring 66 or 68 then returns the handle 50 and the engagement lever 62 or 64 against the stops 58 and 60 to the positions shown in FIGS. 3 and 4, ready for another stroke. At any time when the user desires to retract the movable jaw 36 away from the fixed jaw 23, for example, to release a workpiece or to open the bar clamp to receive a workpiece, it is only necessary to push the fixed jaw 23 in the direction of the arrow 80 while simultaneously compressing the spring 98 by pressing on the brake lever grip 110 of the brake lever 82 in the direction of the arrow 124. To retract the movable jaw 38 away from fixed jaw 22, it is only necessary to push the fixed jaw 22 in the direction of the arrow 78 while simultaneously compressing the spring 100 by pressing on the brake lever grip 112 of the brake lever 84 in the direction of the arrow 126.

It should be noted that the operation of the handle 50 and brake levers 82 and 84 can be accomplished by the same hand while holding the bar clamp with that hand.

Figures 6A, 6B:
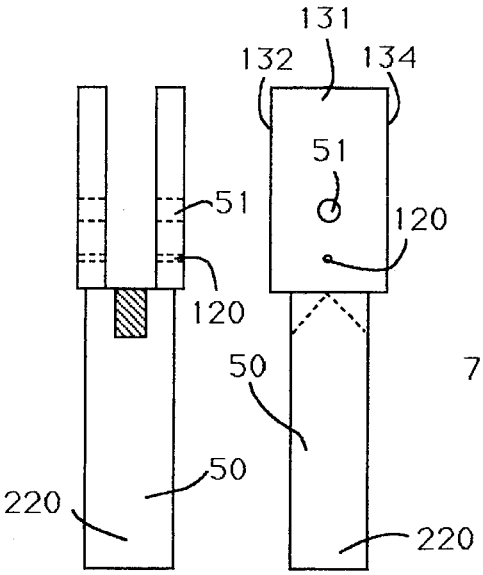
FIGS. 6A and 6B are end and side views of the handle, respectively.
Figures 7A, 7B:
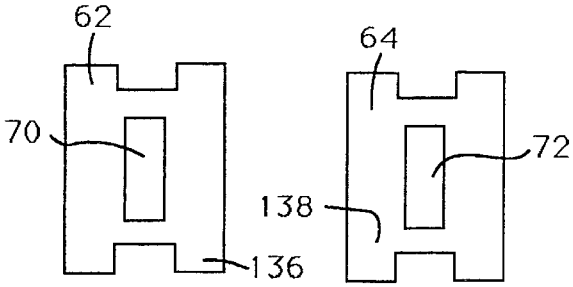
FIGS. 7A and 7B are side views of 1st and 2nd engagement plates.
Figures 8A, 8B, 8C, 8D:
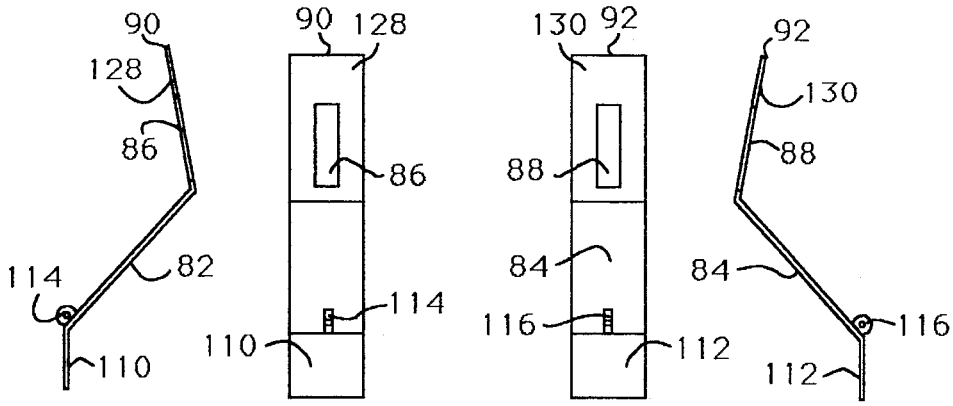
FIGS. 8A and 8B are side and end views of the 1st brake lever, respectively.
FIGS. 8C and 8D are side and end views of the 2nd brake lever, respectively.
Figures 9, 10, 11, 12:
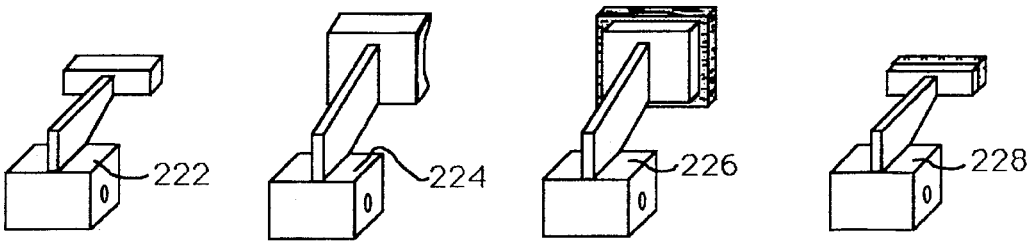
FIG. 9 is an isometric view of a multi-purpose interchangeable jaw.
FIG. 10 is an isometric view of an interchangeable pipe jaw.
FIG. 11 is an isometric view of an interchangeable woodworking jaw.
FIG. 12 is an isometric view of an interchangeable welding jaw.

As illustrated in FIGS. 3, 6A and 6B, the hand (not shown) is typically positioned around the first end 220 of the handle 50.

As best illustrated in FIGS. 1–12, the overall quick-action bar clamp 20 in accordance with the invention is basically flat, takes little space, and can be operated in tight places. The bar clamp 20 can also be converted to stand-alone use as best illustrated in FIGS. 1 and 2. Slide bars 14 of different lengths may be used. Jaws suited for various purposes, such as jaws 222, 224, 226 and 228 can quickly and easily be interchanged or replaced quickly, without the use of hand tools. Jaws suited for other purposes may be used, and are within the scope of the invention.

If it is desired that a workpiece is to be spread apart, either combination of jaws 38 and 23 or 22, or 36 and 23 or 22 may be used. The jaws can be quickly be repositioned by removing the corresponding ball-lock pins and positioning the jaws whereby the faces of the jaws face away from each other, and reinserting the ball-lock pins. Then simply advance the movable jaws 36 or 38 away from the fixed jaws 22 and 23 by activation of the handle 50 and engagement levers 62 and 64 as previously described.

Typically, the movable jaws and associated mounting apparatus are located at the end of the bars, however any suitable location on the bar is acceptable.

Shapes and sizes of jaw mounts and jaw receivers may be, for example round, oblong, rectangular, etc., any suitable corresponding shape or size.

Shapes and sizes of lower parts of jaw mounts and cross-member receivers may be, for example round, oblong, rectangular, etc., any suitable corresponding shape or size. Lower jaw mounts do not have to be the same size or shape as upper parts of jaw mounts, but must correspond to cross-member shape and size.

While the above description contains many specificities, these should not be construed as limitations on the scope of the invention, but rather as an exemplification of one preferred embodiment thereof. Many other variations are possible. For example clamps where there are but one interchangable fixed jaw and one interchangable movable jaw, where there is but one engagement lever that provides two-way drive means, or where specialized jaws are provided for corner clamping. Accordingly, the scope of the invention should be determined not by the embodiment illustrated, but rather by the appended claims and their legal equivalent.

I claim:

1. A hand tool comprising:

(a) a movable jaw mount;

(b) a stationary jaw mount;

(c) a movable jaw, said movable jaw releasably mounted to said movable jaw mount;

(d) a stationary jaw, said stationary jaw releasably mounted to said stationary jaw mount, said stationary jaw being interchangeable with said movable jaw;

(e) a support structure mount;

(f) a slide bar, said movable jaw mount being mounted to said slide bar, said support structure mount being mounted to said slide bar;

(g) a support structure, said support structure being removably mounted to said support structure mount;

(h) support means for said slide bar, said stationary jaw mount being spaced away from said support means;

(i) two-way drive means for releasably engaging, and when engaged, for advancing said slide bar and said movable jaw to an advanced position, said two-way drive means having at least an engagement lever; and (j) a handle means pivotably mounted at said support means, and contacting said engagement lever, said handle means engaging said engagement lever when two-way drive means engages said slide bar, and said handle means disengaging said engagement lever when said two-way drive means is released from said slide bar.

2. A hand tool according to claim 1, wherein said engagement lever is positioned at an angle to said slide bar when said two-way drive means engages the slide bar.

3. A hand tool according to claim 1, wherein said engagement lever is positioned substantially traverse to said slide bar when said two-way drive means is released from said slide bar.

4. A hand tool according to claim 1, wherein more than one said movable jaw, said movable jaw mount, said stationary jaw, said stationary jaw mount, said support structure mount, said support structure or said engagement lever are used.

5. A hand tool according to claim 1, further comprising receiving means in said support means, a release tab pivotable at said receiving means and having an engaging portion adjacent to said slide bar extending outwardly from said support means and away from said handle means for releasably engaging slide bar.

6. A hand tool according to claim 1, wherein said support structure is mounted to said support means.

7. A hand tool comprising:

(a) a movable jaw mount;

(b) a stationary jaw mount;

(c) a movable jaw, said movable jaw releasably mounted to said movable jaw mount;

(d) a stationary jaw, said stationary jaw releasably mounted to said stationary jaw mount, said stationary jaw being interchangeable with said movable jaw;

(e) a support structure mount;

(f) a slide bar, said movable jaw mount being mounted to said slide bar, said support structure mount being mounted to said slide bar;

(g) a support structure, said support structure being removably mounted to said support structure mount;

(h) support means for said slide bar, said stationary jaw mount being spaced away from said support means; and (i) two-way drive means for releasably engaging, and when engaged, for advancing said slide bar and said movable jaw to an advanced position.

* * * * *